United States Patent [19]

Hutchins

[11] Patent Number: 4,875,199

[45] Date of Patent: Oct. 17, 1989

[54] DEEP WATER TRANSIENT SOUND GENERATOR

[76] Inventor: Roger W. Hutchins, 88 Duplex Avenue, Toronto, Ontario, Canada, M5P 2A4

[21] Appl. No.: 228,151

[22] Filed: Aug. 4, 1988

Related U.S. Application Data

[63] Continuation-in-part of Ser. No. 904,435, Sep. 9, 1986, abandoned.

[51] Int. Cl.[4] ..... H04R 15/00

[52] U.S. Cl. ..... 367/175; 367/172

[58] Field of Search ..... 367/163, 167, 171, 172, 367/174, 175; 181/104, 106, 113, 402; 310/26; 381/188, 192, 193, 205

[56] References Cited

U.S. PATENT DOCUMENTS

| | | | |
|---|---|---|---|
| 2,897,475 | 7/1959 | Harris | 367/175 |
| 2,903,673 | 9/1959 | Harris | 367/172 X |
| 2,906,993 | 9/1959 | Steinberger | 340/8 PC |
| 2,978,669 | 4/1961 | Harris | 367/175 |
| 3,118,125 | 1/1964 | Sims | 367/175 |
| 3,150,345 | 9/1964 | Freeman | 367/174 X |
| 3,336,573 | 8/1967 | Gallaway | 340/17 |
| 3,560,913 | 2/1971 | Copley | 367/141 |
| 3,764,966 | 10/1973 | Abbagnaro | 367/172 |
| 3,993,973 | 11/1979 | Hutchins | 340/8 PC |

FOREIGN PATENT DOCUMENTS

| | | | |
|---|---|---|---|
| 1029846 | 4/1978 | Canada | 349/50 |

*Primary Examiner*—Brian S. Steinberger

*Attorney, Agent, or Firm*—Rogers, Bereskin & Parr

[57] ABSTRACT

This invention relates to an underwater transient sound generator capable of operating at substantial depths. The pulse produced by the generator is used to determine subbottom terrain in underwater surveying. Essentially, the invention consists of an electromagnetic coil, which is embedded in an annular support body with a central hole. A piston is located next to the coil, but is separated therefrom by a dielectric sheet. A rubber seal and spring are used to locate the piston in position. A body portion extends back from the support body with two open ends. The rear end is covered with a water tight flexible diaphragm and the front end connects with the central hole of the support body, defining a watertight pressure transfer space, containing a pressure transfer medium. The coil is capable of being energized to rapidly displace the piston to a forward position. Two embodiments are shown in which the pressure transfer medium is either a gas or a fluid. In the gas filled embodiment a check valve is placed in the space dividing it into two portions. On the outward stroke of the piston, the gas can flow into the piston space. On the return stroke of the piston gas flow is blocked by the check valve. A bleed tube is provided around the check valve to permit gradual pressure equalization to occur as the piston is returned to its original position. In the second embodiment, the fluid is a non-cavitating low viscosity liquid, which acts in combination with the spring to initially dampen the return stroke of the piston.

8 Claims, 2 Drawing Sheets

DEEP WATER TRANSIENT SOUND GENERATOR

This is a continuation-in-part of application Ser. No. 904,435 filed Sept. 9, 1986 now abandoned.

FIELD OF THE INVENTION

This invention relates to a transient sound generator. This invention more particuarly relates to an underwater sound generator capable of being submerged to great depths while producing a highly reproducible pulse of acoustical energy in the water, that is synchronous with a trigger signal provided, for example, by a graphic recorder.

BACKGROUND OF THE INVENTION

Underwater transient sound generators have been known and are used extensively to determine the profile of the sub-bottom terrain in underwater surveying. The present invention is concerned with an improved underwater transient sound generator of the kind which employs a piston plate which is repelled outwardly into the water by means of eddy currents induced in the plate by an energized coil. One example of this type of device is disclosed in U.S. Pat. No. 3,993,973 entitled "Underwater Transient Sound Generator Having Pressure Compensating Fillet", which issued on Nov. 23, 1976, of which I was a co-inventor.

Essentially, the invention disclosed in this prior U.S. patent consists of a structure for the improved tracking of the pressure at the rear face of the piston with the pressure at the front face of the piston. In this manner, as the device was raised or lowered in depth in the water, the ambient pressures on the front and rear faces of the piston would vary identically, resulting in the pressure pulse produced by the piston remaining constant over varying depths of submergence of the device.

However, there are a number of undesirable limitations of the invention disclosed in this prior patent. The prior invention has a maximum operating depth, which occurs when the rear diaphram is pressed against the fillet, thereby transferring all of the compressed gas to the non-compressible gas space at the rear face of the piston. Any further increase in depth will result in a change in the ambient pressure between the front and rear faces of the piston, and undesirable changes to the acoustic pulse signature.

The maximum depth of operation of the prior device can be extended by either of two methods: by increasing the initial volume of the compressible gas space, or by decreasing the initial volume of the non-compressible gas space. With respect to increasing the volume of the compressible gas space, because an additional volume in the compressible gas space equal to the volume of the non-compressible gas space is required for each additional atmosphere of ambient pressure, increasing the compressible gas space is not practical for deep water sound generation, as the volume required would result in a large and awkward device. A further disadvantage of this solution is that as the volume changes, the bouyant forces on the submerged device change. This change can result in the device being unstable, with the acoustical pulse being poorly and erratically aimed as it is towed above the seabed.

Making the non-compressible gas space smaller, seems to present two advantages. Firstly, for the same overall size of the sound generator, increased depth of operation can be achieved, without any greater instability at depth. Secondly, and most importantly, the closer the piston is to the coil, the tighter the electromagnetic coupling between the driver and the coil, and thus the lower the initial effective inductance of the coil curcuit. Because the initial inductance is lower, a greater efficiency of conversion of electrical energy into mechanical (acoustical) energy is possible.

Unfortunately, other phenomena affect the piston dynamics, limiting the effectiveness of reducing the volume of the non-compressible gas space. The spring constant of the gas contained in this prior invention is proportional to the ambient pressure. The greater the depth, and thus ambient pressure, the stiffer the gas spring. It should be noted that the gas spring acts both to resist the movement of the piston outwards, and to return the piston to its normal position closely adjacent the coil. Therefore, at greater depth as the gas spring gets stiffer, the outward stroke of the piston becomes shorter, and the return velocity becomes greater for the piston. This change in stroke dynamics changes the nature of the acoustic pulse produced. If the electrical input energy is increased the piston stroke can be made longer but again the maximum velocity of the piston increases. As the higher velocity piston has a greater momentum, on the return stroke it will tend to overshoot its normal rest position and strike the coil. Striking the coil causes the piston to stop suddenly, creating a secondary and unwanted acoustical pulse. The secondary pulse creates unacceptable noise, altering the acoustical signature and rendering the underwater survey results difficult or impossible to interpret.

Another limitation on reducing the non-compressible gas space becomes evident when the input energy is considered. There are good reasons to operate the device at relatively high energy levels, where increasing the input energy is considered as increasing the voltage for the same capacitance. Firstly, at a higher input energy, a stronger acoustical pulse is produced, which increases the depth of the subsurface penetration of the seabed by the acoustical pulse. Secondly, the higher the input energy, the greater the efficiency of the electrical to mechanical energy conversion.

Unfortunately, as the input energy is increased, so to is the velocity of the piston on the outward and inward strokes. In the prior device, a gap exists between the rear face of the piston and the coil. The piston tends to oscillate about the rest position, after the stroke cycle. The greater the piston velocity, the greater the amplitude of the oscillation and consequently for a given gap, at a certain input energy the oscillation is sufficiently large to cause the piston to strike the coil, creating the unwanted secondary pulse.

As a result, the minimum gap between the piston and the coil is a function of the maximum input energy required to achieve the desired subsurface penetration. It has been found that this design limitation results in a much lower input energy than would otherwise be possible, if, for example, the thermal conductivity of the support body was the limiting design factor.

In summary, the prior art device cannot usefully be adapted to deep water soundings because to extend the depth of operation of the device results in a bulky and awkward device, or in the unwanted and destructive production of a secondary sound pulse. Further, the device is limited to a maximum input energy which limits the efficiency of the device and reduces its depth of subsurface penetration.

A further problem with the prior invention is that as a result of the energy released by the coil, the body of the sound generator has a tendency to heat up, causing thermal stresses which can reduce the life expectancy of the device.

BRIEF SUMMARY OF THE INVENTION

The present invention provides a means for allowing the device to be submerged to a great depth for deep water soundings while being able to maintain the same acoustic pulse, being able to operate at high levels of input energy, and at the same time controlling and eliminating any secondary pulse. To this end the invention provides an underwater transient sound generator comprising an underwater pulse generator capable of generating large amplitude pulses and having input powers in the range of 100,000 and 1,000,000 watts, said generator comprising:

(1) a coil;
(2) a support body defining a rear support for said coil;
(3) a piston;
(4) a driver carried by said piston;
(5) a resilient piston seal between said support body and said piston;
(6) a resilient rear diaphragm at the rear of said support body, said resilient piston seal and said resilient rear diaphragm defining, in combination with said piston and said support body, a watertight pressure transfer space at the rear of said piston;
(7) a substantially imcompressible pressure transfer liquid located within said pressure transfer space;
(8) means for energizing said coil to rapidly displace said driver, and thereby said piston to a forward position; and
(9) a spring acting between said piston and said support body for restoring said piston to a normal position;

and when said generator is in use, said pressure transfer liquid flowing at subsonic velocity during said rapid displacement of said piston from said coil upon said coil being energized, said pressure transfer liquid, in combination with said spring critically dampening said piston upon said piston returning to said normal position.

BRIEF DESCRIPTION OF THE SEVERAL VIEWS OF THE DRAWING

In the drawings which illustrate embodiments of the invention.

DETAILED DESCRIPTION

Figure 1:
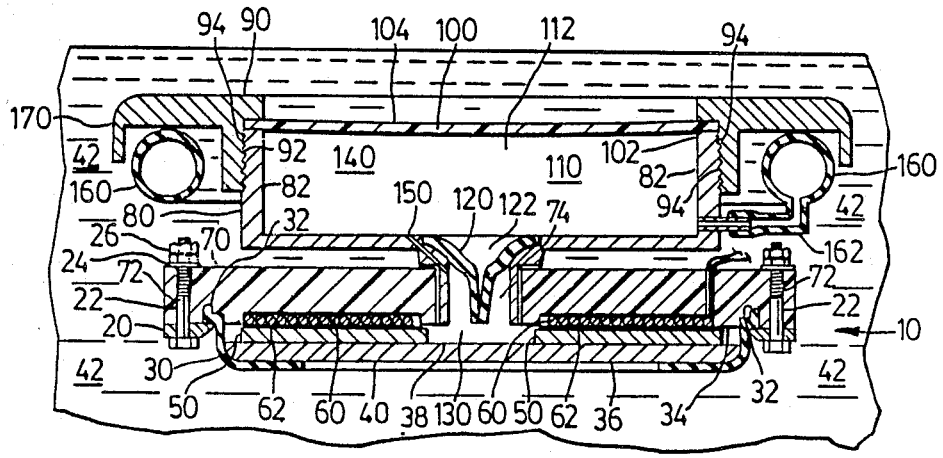
FIG. 1 is an elevation partly in section of one embodiment of the invention.
Figure 2:
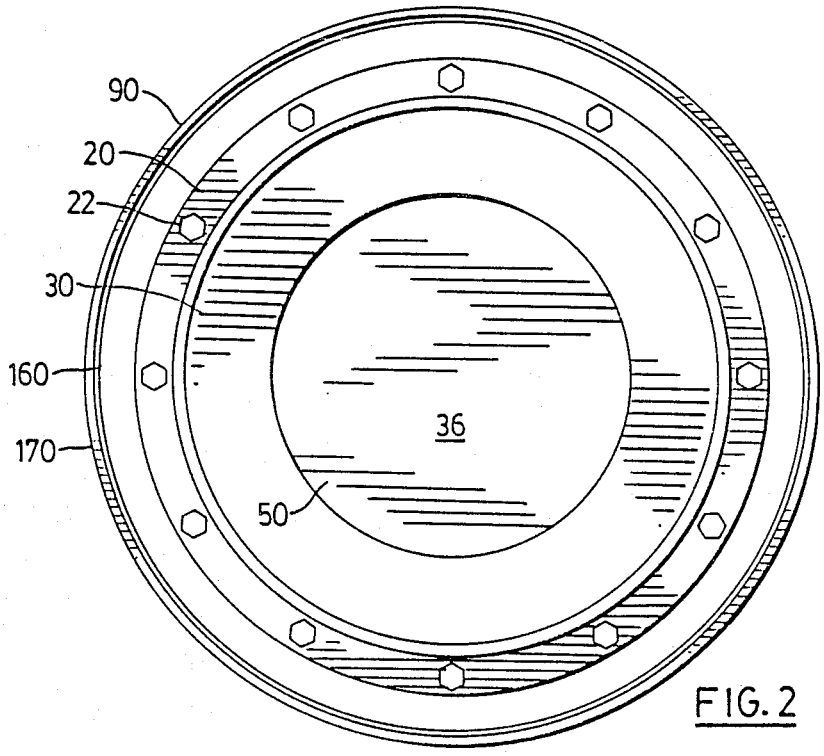
FIG. 2 is a bottom plan view of the first embodiment of the invention.

In FIG. 1, a preferred embodiment of the transient sound generator according to the present invention is shown and is indicated generally at 10. The sound generator 10 includes a number of elements, including a clamping ring 20, a piston seal 30, a piston 40, a piston driver 50, a coil 60, a support body 70, a body portion 80, a retaining ring 90, a rear diaphragm 100, a check valve 120 and a bleed passage 150, which are interrelated as described below.

The clamping ring 20 is attached to the lower surface of support body 70 by any suitable means. In the preferred embodiment illustrated in FIG. 1, ten bolts 22 are used, spaced evenly around the centerline of the ring 20. Each bolt 22 has a washer 24 and preferably has two nuts 26. Two nuts 26 are required to securely lock the nuts 26 to the bolts 22 to withstand the intense vibration which occurs in the sound generator 10 when in use.

A piston seal 30 is held in place by the clamping ring 20, which in turn is held in place by the bolts 22 as aforesaid. The piston seal 30 is held by the clamping ring 20 in a groove 32, located in the lower face 34 of support body 70. The piston seal 30 is preferrably made from molded neoprene elastomer and is bonded to the outer face 36 of the piston 40. The piston seal has two functions, namely, it forms a watertight seal excluding water from the rear face 38 of piston 40, and it provides a restoring force which both returns and retains the piston 40 closely adjacent the coil 60.

The piston 40 is accelerated rapidly outwards against the surrounding water 42 to produce the acoustic pulse. The piston 40 must be rigid, able to withstand fatigue stresses, and be corrosion resistant. It has been found that a circular sheet of titanium or stainless steel is a suitable piston.

The piston driver 50 is an annular strip or sheet of metal bonded or otherwise appropriately fastened to the rear face 38 of the piston 40. Copper is particularly suitable as the metal for use as the piston driver 50, which is preferably of the same dimensions, both in thickness and in annular size as the coil 60. At the present time, in view of the differing requirements for the driver 50 and the piston 40, they are formed separately, from different materials. However, it may be possible to form a unitary piston and driver unit out of one material.

The coil 60 is also preferably composed of copper, and is moulded into the support body 70. The two ends of the coil 60 (not shown) are connected to a triggered capacitor bank (not shown) by any conventional means, such as pig tail leads. The coil 60 is covered with a thin sheet of material 62 having a high dielectric strength, such as MYLAR, to provide electrical insulation between the coil60 and the piston driver 50.

The piston 40 and in particular the driver 50 are located closely adjacent the coil 60 when the piston 40 is in its rest position. Closely adjacent in this sense is vanishingly small and in essence is the thickness of the dielectric sheet disposed between the driver 50 and the coil 60.

The support body 70 is preferably a large annular shaped casting, in which the groove 32 is formed and the coil 60 is moulded. Also the support body 70 has a series of holes 72 cast in for the bolts 22 which retain the clamping ring 20 and a central hole 74. The support body 70 should be strong enough to withstand the impact reaction of the coil 60. Also, the support body 70 should be cast of material which has two specific thermal properties. Firstly, the material should be thermally conductive, to allow thermal energy created at the coil 60 to be transported through the support body 70 to the surronding water 42. Also, the material should have a coefficient of thermal expansion which is close to or identical with the metal of the coil 60, which in the preferred embodiment is copper. In this manner destructive stresses created by differential thermal expansion can be reduced. It has been found that STYCAST, manufactured by Emmerson & Cummings, is a suitable thermally conductive expoxy resin.

The body portion 80 is shown fitting into the central hole 74 of the annular support body 70, and can be attached by any suitable adhesive-sealant such as FLEXANE. The body portion 80 has continuous side walls 82 which are in the form of a cylinder in the preferred embodiment. The body portion 80 forms a volume, the purpose of which is more fully described below.

The retaining ring 90 attaches to the outer edge 92 of the side walls 82 of the body portion 80. The retaining ring 90 may be attached by threads 94, located on the outer face of side walls 82 and the inner face of retaining ring 90, as shown in FIG. 1. The purpose of retaining ring 90 is to hold and locate the rear diaphragm 100 in position across a rear opening 102 of body portion 80. The rear diaphragm 100 is composed of an elastic flexible material such as NEOPRENE, and is therefore free to deflect axially, while preventing the surrounding water 42 from entering into the sound generator 10.

As will be appreciated from the foregoing description, the surrounding water 42 is prevented from entering into the second generator 10. A pressure transfer space 110 is created by the piston seal 30, the piston 40, the support body 70, the body portion 80 and side walls 82, and the rear diaphragm 100, inside the sound generator 10. The pressure transfer space 110 contains a pressure transfer medium 112 as described herein.

The body portion 80 defines an annular opening 122 extending through the central hole 74 of the support body 70. The check valve 120 is located in the annular opening 122. The check valve 120 divides the pressure transfer space 110 into two portions, namely, a non-compressible space 130 and a compressible space 140. As can be seen from FIG. 1, the non-compressible space 130 is on the piston 40 side of the check valve 120, and the compressible space 140 is on the rear diaphragm 100 side of the check valve 120.

The check valve 120 is preferably cast from a high quality elastomer in the form of what is known as a duck bill check valve. The check valve 120 allows the pressure transfer medium 112, which is preferably air in this embodiment to flow into the non-compressible space 130 from the compressible gas space 140, but blocks the flow of the air in the reverse direction. The operation of the check valve 120 is more fully described below.

The bleed passage 150, communicates between non-compressible space 130 and compressible space 140 around check valve 120. The bleed passage 150 is preferable in the form of a narrow bore tube drilled or formed into the body portion 80.

Also shown in FIG. 1 is an external compressible space 160, and barrier 170. External compressible space 160 may be optionally added where it is desired to extend the depth capability of the sound generator 10. It has been found that a bicycle tire inner tube is suitable for use as an external compressible space 160 because it is both elastic and compressible. The space 160 is placed in communication with the pressure transfer space 110 by means of a capillary tube 162, and prior to submerging the sound generator 10, space 160 is inflated to a slight positive pressure.

It can now be appreciated that as the present invention is submerged, the ambient pressure at the outer face 36 of the piston 40 increases. However, because the rear diaphragm 100 is elastic and flexible it will deform under the increase in ambient pressure on its outer surface, transmitting an increase in pressure to the rear face 38 of piston 40. In this manner the pressure differences between the front face 36 and rear face 38 of the piston 40 are almost eliminated notwithstanding changes in ambient pressure in the surrounding water 42.

The operation of the invention will now be described. In the first embodiment, in which the pressure transfer medium in the sound generator 10 is air, operation of the invention commences with a trigger signal, for example, from a graphic recorder (not shown). The trigger signal causes the power source, a triggered bank of capacitors, to emit a very high pulse of current (e.g. 10,000 amperes) thereby energizing the coil 60 and creating eddy currents in the piston driver 50. The resulting Lorenz forces created between the coil 60 and the piston driver 50 cause the piston 40 to be rapidly propelled against the surrounding water 42.

As the piston 40 is driven out into the surrounding water 42 (and thereby creating the desired acoustical pulse) the pressure in the non-compressible space 130 is reduced below that of the pressure in the compressible space 140. This creates a flow of air from the compressible space 140 to the non-compressible space 130 through check valve 120. When the piston 40 has completed its outward stroke, the elastic forces in the piston seal 30, together with the hydrostatic pressure due to the difference in depth between the rear surface 104 of the rear diaphragm 100, and the front face 36 of the piston 40 and the internal spring constant of the air itself cause the pison 40 to begin its return stroke. However, during the return stroke, check valve 120 closes, blocking the reverse flow of air from the non-compressible gas space 130 to the compressible gas space 140 limiting the rate of return of the piston 40. As the piston 40 is now being urged to return to its normal position closely adjacent the coil 60, but is being prevented from doing so, the pressure in the non-compressible space 130 is higher than in the compressible space 140. Bleed passage 150 provides a slow method for pressure equalization to take place. The return stroke of the piston 40 is critically or overdamped by the check valve 120 and bleed passage 150 so that the piston 40 will gradually return to the rest position without overshooting and thereby without creating an unwanted secondary pulse. It will now be appreciated that the piston 40, in its normal or rest position can be in contact with the thin sheet 62 of dielectric material thereby reducing the non-compressible gas space volume, and increasing the electrical to mechanical conversion efficiency. Further, because the piston 40 does not oscillate about its rest position as did the prior art device, the input energy can be increased as desired to achieve improved subsurface penetration and to allow the sound generator to operate at an overall greater efficiency.

Where the optional external compressible space 160 and barrier 170 are present, the depth capability is increased. The barrier 170 is used to retain the external compressible space 160 in place. The barrier 170 keeps the external compressible space 160 from rising above the topsurface of the rear diaphragm 100, where it is forced by the bouyant forces in the water. As long as the external compressible space 160 remains below the upper surface of the rear diaphragm 100, the pressure on it will be greater than the pressure in the upper part of the pressure transfer space 110, thereby driving the gas from the external compressible space into the pressure transfer space. The larger the volume of the external compressible space, the greater the depth capability of the sound generator 10. It will now be appreciated that the use of the external compressible space 160 will also tend to reduce the deflection of rear diaphragm 100, and therefore also reduce the pressure difference between the outer face 36 and rear face 38 of piston 40 due to the internal elastic forces of diaphragm 100. It should be noted that suitable vent holes (not shown) should be made through barrier 170 to allow any air trapped during launching of the sound generator 10 to escape.

Figure 3:
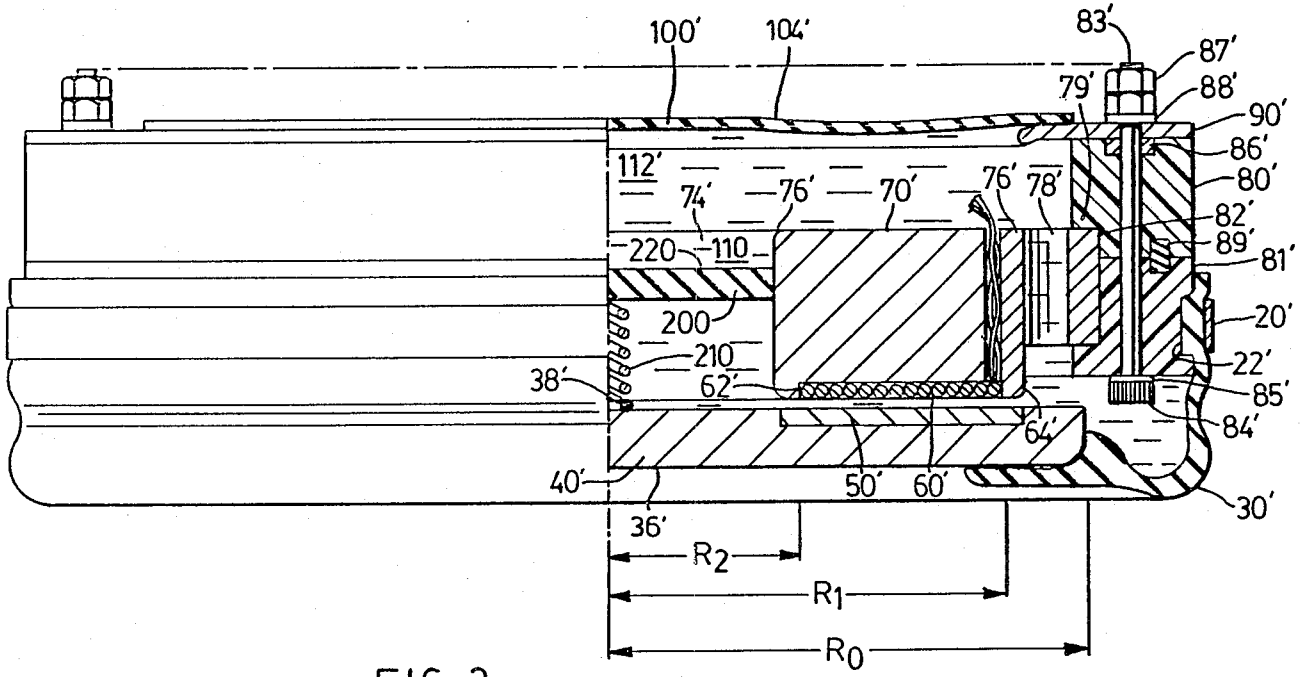
FIG. 3 is an elevation, half in section of a second embodiment of the invention.

The second embodiment, as illustrated in FIG. 3, is similar to the first embodiment, but no check valve 140, bleed passage 150, external compressible space 160 or barrier 170 are shown. In FIG. 3, for convenience like numbers as used in FIG. 1 are used with an apostrophe to indicate similar components of the invention. In the second embodiment, the pressure transfer medium 112' takes the form of a low viscosity cavitation resistant fluid. The fluid should also be free of dissolved gas. Suitable fluids are Dow Corning #200 Silicone Fluid with a viscosity of 0.65 centipoises, or degassed distilled water.

The second embodiment shown in FIG. 3, includes a number of elements, including a clamping ring 20' a piston seal 30', a piston 40', a piston driver 50', a coil 60', a support body 70', for the coil 60', upper and lower clamping blocks 80' and 81' respectively, a stainless steel cover ring 90' and a rear diaphragm 100'.

The clamping ring 20' is used to retain the moulded piston seal 30' against lower clamping block 81'. Clamping ring 20' is preferably made from a metal strap, which is looped around the outside of the device. A notch 22' is formed in lower clamping block 81' to secure piston seal 30' between the ring 20' and the lower block 81'.

The lower end of piston seal 30' is bonded to the piston 40' by any suitable bonding technique, such as by thermal bonding. Piston 40' carries piston driver 50', which in the normal position rests closely adjacent coil 60'. In this sense, closely adjacent means in the order of a millimeter or less, but there should be a sufficient gap to ensure that there is always some fluid between the coil 60' and the driver 50'. As in the first embodiment, coil 60' is moulded in support body 70'.

It will be noted that support body 70' has several differences from the support body 70 of the first embodiment. The radius of the central hole 74', for example, has been expanded to almost the inner edge 62' of coil 60'. As seen in FIG. 3, Ro represents the radius of the piston 40'. R1 represent radius of the external edge 64' of the coil 60' and R2 represents the internal edge 62' of coil 60'. Good results are obtained when the configuration conforms to $R1/Ro=0.840$ and $R2/Ro=0.454$.

Also shown in FIG. 3, are rim fluid passage holes 78'. The purpose of the holes 78' is to provide a fluid flow path near the outer edge of the piston 40', thereby reducing the distance the fluid must travel to fill in behind the piston 40', during the outward stroke of piston 40'. In this manner the fluid velocity is reduced well below the velocity of which cavitation is likely to occur. The fluid flow velocity is much less than the sonic velocity of the fluid.

In the above described configuration the net volume of fluid that moves into the gap between the piston 40' and the coil 60' that occurs as the piston 40' is driven outwardly is greatly reduced as compared to the net volume of air that moves in to the gap in the air filled embodiment. The addition of the holes 78', in combination with the reduced volume of fluid as aforesaid allows the fluid flow velocity during the outward stroke of the piston 40' to be slower, and within acceptable operating levels because the length of the flow path is greatly reduced. However, the holes 78' are not essential, because all that is really required is a sufficiently short flow path for the fluid to ensure its maximum velocity is well below sonic velocity.

It will also be noted that the support body 70' has rounded corners 76' to facilitate smooth flow of the fluid during the stroke cycle of the piston 40'.

Support body 70' is again preferrably made of a thermoplastic resin, as described with respect to the first embodiment. Support body 70' is formed with a rim 79' extending past rim holes 78' into matching grooves 82' located in upper clamping block 80' and lower clamping block 81'. Upper and lower clamping blocks 80' and 81' are held together by a number of bolts 83', which in turn, hold support body 70' in place in grooves 82'.

In FIG. 3, a bolt 83' is shown. Bolt 83' has a head 84' and a first elastomeric washer 85' countersunk at the lower end. It will be appreciated by those skilled in the art that the orientation of the bolt could be reversed. The bolt 83' passes through lower and upper blocks 80' and 81', and then through stainless steel cover ring 90'. Between upper clamping block 80' and cover ring 90' is located a second flat washer elastomer 86', which dampens the vibration transmitted through the block 80' to the bolt 83'. Elastomer 86' takes the form of a continuous washer which is countersunk with appropriate holes for the bolts 83', and prevents sea water from entering into the pressure transfer space between upper clamping block 80' and plate 90'. In addition, the first and second elastomeric washers prevent sea water from entering into the pressure transfer space 110' around the bolt 83'. Bolt 83' is retained by a pair of locking nuts 87' in combination with a lock washer 88'.

Also shown in annular elastomer seal 89' which is located between upper clamping block 81' and lower clamping block 82'. The seal 89' prevents sea water from entering into the pressure transfer space 110' between the clamping blocks 81' and 82'. In this manner, the integrity of the pressure transfer fluid 112' is maintained.

As in the first embodiment, the second embodiment has a rear diaphragm 100', which in this case is attached by any suitable adhesive to the cover ring 90'. As previously stated FLEXANE has been found adequate as an adhesive.

In the second embodiment, as mentioned previously, the pressure transfer space 110', is filled with a suitable pressure transfer fluid 112'. In this embodiment the check valve and bleed passage are not required. Since the fluid is only slightly compressible, if at all, the volume of fluid does not change significantly, even at the extremely high ambient pressures found in the deepest parts of the oceans. Therefore, the external compressible space of first embodiment is not required. The small pressure difference between the rear surface 104' of the rear diaphragm 100' and the outer surface 36' of the piston 40' arising because of the depth difference between these two surfaces is also minimal, and if the fluid in the device has the same density as sea water, the pressure difference will be eliminated. Therefore, easy axial movement of the piston is facilitated.

Further, some restoring force will be the elastic properties of the piston seal 30', which is moulded in a form that retains the piston 40' adjacent the coil 60'. However, at depth it will be desireable to utilize an additional restoring force. As shown in FIG. 3, a spring bracket 200 supporting a tension spring 210 are shown. It will be appreciated that the spring 210, could also be a compression spring, acting, for example between the top 220 of the spring bracket 200 and a rod (not shown) connected to the rear of the piston. The spring 210 is preferrably preloaded to a force at least sufficient to retain the piston and the driver in the normal position against the force of gravity. The fluid between the inner surface 38' of piston 40' and the support body in combination with the spring 210 result in the return stroke of piston 40' being critically or over dampened, and without a rapid deceleration.

The first embodiment of the invention as previously described is expected to be capable of producing the desired acoustical pulse in up to 100 meter deep water. On the other hand, the second embodiment of the invention will be capable of successfully operating at any depth since the output of the device is independent of the ambient pressure.

In terms of operating characteristics, the second embodiment preferrably operates over a range of input energies from 100 joules to 1,000 joules, which translates to a peak power range of 100,000 watts to 1,000,000 watts. This translation is based on the time duration of the discharge current through the coil of about one millisecond. Typically, the capacitor would be of 30 microfarad capacity, which would be charged with up to 6,000 volts (this is about 540 joules of input energy, or about the middle of the preferred operating range).

The efficiency of the second embodiment, and of these types of devices in general, is in the order of 0.1%. Thus, the peak pressure at 1 meter would preferrably range from $1.4\times10^4$ to $4.3\times10^4$ pascals, while the peak acoustic intensity would preferrably range from 13 to 1300 watts/$m^2$. The energy density, again at 1 meter, would preferrably range from $3.6\times10^{-4}$ to $3.6\times10^{-2}$ joules $m^2$. It will be appreciated by those skilled in the art that the foregoing is in reference to particular embodiments of the invention, and that variations are possible still within the broad scope of the invention. For example, the configuration of the second embodiment must be such that subsonic velocity is maintained in the fluid as the piston is expelled outwardly. While it has been suggested that holes be provided around the perimeter, to shorten the fluid pathway, these may not be necessary.

I claim:

1. An underwater pulse generator capable of generating large amplitude pulses and having input powers in the range of 100,000 to 1,000,000 watts, said generator comprising:

(1) a coil;

(2) a support body defining a rear support for said coil; said support body having a large central hole and one or more relatively smaller holes arranged about the periphery of the coil carrying support of the support body;

(3) a piston;

(4) a driver carried by said piston;

(5) a resilient piston seal between said support body and said piston;

(6) a resilient rear diaphragm at the rear of said support body, said resilient piston seal and said resilient rear diaphragm defining, in combination with said piston and said support body, a watertight pressure transfer space at the rear of said piston;

(7) a substantially incompressible pressure transfer liquid located within said pressure transfer space;

(8) means for energizing said coil to rapidly displace said driver, and thereby said piston to a forward position; and (9) a spring located between said piston and said support body for restoring said piston to a normal position;

and when said generator is in use, said pressure transfer liquid flowing at subsonic velocity during said rapid displacement of said piston from said coil upon said coil being energized, said pressure transfer liquid, in combination with said spring critically dampening said piston upon said piston returning to said normal position.

2. An underwater pulse generator as claimed in claim 1 wherein said spring is initially loaded to at least retain the piston and the driver in the normal position against the force of gravity.

3. An underwater pulse generator as claimed in claims 1 or 2 wherein said support body is generally circular and has at least one hole therethrough, said hold having one end adjacent said piston and said rear diaphragm extends across said support body at the other end of said hole from said piston.

4. An underwater pulse generator as claimed in claim 2 wherein said support body further comprises an upper clamping block and a lower clamping block and a coil carrying portion, said coil carrying portion having an outer rim clamped between said upper clamping block and said lower clamping block.

5. An underwater pulse generator as claimed in claims 1 or 2 wherein said fluid is degassed distilled water.

6. A pulse generator as claimed in claims 1 or 2, wherein said support body is composed of a thermally conductive resin, having a co-efficient of thermal expansion substantially the same as said coil.

7. A pulse generator as claimed in claims 1 or 2 wherein said support body is composed of cast STYCAST resin.

8. An underwater pulse generator as claimed in claims 1 or 2 wherein said piston is circular and has a radius Ro, said coil is annular and has a radius to an internal edge of R1 and to an external edge of R2, and wherein $R1/Ro=0.84$ and $R2/Ro=0.454$.

* * * * *